United States Patent [19]

Hutzenlaub

[11] 4,117,986

[45] Oct. 3, 1978

[54] ROLLER CUTTING AND WINDING MACHINE

[75] Inventor: Armin Hutzenlaub, Wiehl, Germany

[73] Assignee: Firma Erwin Kampf Maschinenfabrik, Germany

[21] Appl. No.: 804,923

[22] Filed: Jun. 9, 1977

[51] Int. Cl.[2] ..... B65H 35/02

[52] U.S. Cl. ..... 242/56.2; 242/56 R; 242/65

[58] Field of Search ..... 242/56.2, 56.3, 56.4, 242/56.5, 56.6, 56.7, 56.9, 58.6, 67.1 R, 67.2, 67.3 R, 65, 56 R

[56] References Cited

U.S. PATENT DOCUMENTS

| | | | |
|---|---|---|---|
| 3,291,412 | 12/1966 | Rockstrom | 242/56.2 |
| 3,332,636 | 7/1967 | Rockstrom | 242/65 |
| 3,949,948 | 4/1976 | Tomma | 242/56.2 |

FOREIGN PATENT DOCUMENTS

| | | | |
|---|---|---|---|
| 1,287,859 | 9/1972 | United Kingdom | 242/56.2 |

*Primary Examiner*—Edward J. McCarthy
*Attorney, Agent, or Firm*—Victor E. Libert

[57] ABSTRACT

A roller cutting and winding-up machine has, subsequent to a cutting station, winding-on stations on both sides of a deflecting and supporting roll. Each winding-on station comprises two brackets, on each of which is mounted one of two swivel arms which, independently of the swivel arms of the other winding-on stations, are adapted to be swivelled between a coil winding-on position and a coil depositing position. The arms are driven by means of a power-medium operated tooth rack via a toothed wheel so that by a single drive means there is provided not only contact pressure for the winding-on operation but a large swivelling range of the arms. The brackets of the winding-on stations are individually movable transversely of the working area range of the machine.

12 Claims, 3 Drawing Figures

ROLLER CUTTING AND WINDING MACHINE

BACKGROUND OF THE INVENTION

The invention relates to a roller cutting and winding machine. In the case of a known roller cutting and winding machine there is provided an unwinding for a broad material band. The material band runs via deflecting rolls into a cutting device, where the material band is cut into longitudinal strips. Subsequent to the cutting device the individual strips are guided via a deflecting and supporting roll to a plurality of winding-on stations, in which there are formed individual coils on both sides of the deflecting and supporting roll. Each winding-on station comprises swivel arms which are adjusted by a power-medium cylinder. The swivelling range comprises the winding range. For the deposition of the individual coils the complete traverse member which supports the different winding-on stations, is adapted to be swivelled.

The object of the present invention is to provide a novel machine which provides an improvement of the handling ability of the individual winding-on stations. In compliance with a special object of the invention it shall be possible to swivel the individual winding-on stations, in each case independently of the other winding-on stations, from the winding position into a depositing position.

A further object of the present invention relates to the improvement of the adaptability of the machine to the winding of coils of different band widths.

A further object aspires to the production of coils having different diameters, i.e. of coils having different band lengths.

According to a further object of the invention, the unwinding is improved in such a manner that the exchange of the empty coil tube and a new full coil is sped up.

SUMMARY OF THE INVENTION

In accordance with the present invention, there is provided in a roller cutting and winding machine to cut a broad material band into a plurality of longitudinal strips and form the strips into individual coils, the combination therewith of the following. A pair of spaced apart shield plates has a deflecting and supporting roll mounted at its opposite ends between the shield plates. A pair of traverse members each has a profile rail thereon and is supported on the shield plates on opposite sides of the deflecting and supporting roll. A cutting device is operatively associated with a counter cutting roll and is supported between the shield plates to cut a broad material band into longitudinal strips. A plurality of winding-on stations mounted on the traverse members and operatively associated with the deflecting and supporting roll to form individual coils of the longitudinal strips upon the winding-on stations. The winding-on stations each comprise bracket means and a pair of swivel arms mounted adjacent one end thereof on shaft means journaled in the bracket means for swivelling movement of the swivel arms about a swivel axis defined by the longitudinal axis of the shaft means. Clamping heads are carried on the swivel arms adjacent the free ends thereof and are adapted to carry a coil tube thereon, and a toothed wheel is concentrically keyed to the shaft means. A powered tooth rack is engaged with the toothed wheel whereby movement of the tooth rack swivels the swivel arms about their swivel axis between a coil winding-on position and a coil depositing position.

Certain objects of the invention are attained when the winding-on stations each comprise two brackets, each bracket having a shaft means journaled therein, and a connecting rod connects the two swivel arms to each other eccentrically with respect to their swivel axis. Other objects of the invention are attained when the connecting rod is exchangeable to be adapted to a specific required coil width, and each bracket is individually movable transversely of the machine along the traverse members.

The present invention also attains certain of its objects when each winding-on station is adapted to be individually swivelled between its winding-on and depositing positions. Further, certain objects are attained when the traverse members extend beyond at least one of the shield plates so that at least one of the brackets and swivel arm assemblies comprising a winding-on station can be moved out of the working range of the machine.

Certain other objects of the invention are attained when the combination further includes an unwinding device having a pair of coil support arms swivellable between an unwinding position and a receiving position and having respective free ends at which support heads are respectively mounted. The support heads are adapted to support a tube from which a coil of the broad material band is unwound when the unwinding device is in its unwinding position, and the combination further includes lateral guide rails positioned transversely of the coil axis defined between the support heads. Other objects are attained when a removal station is provided disposed adjacent one end of the lateral guide rails and when inlet guide rails extend into the receiving position of the unwinding device.

In certain aspects, the present invention relates to a roller cutting and winding-up machine, in which, subsequent to a cutting station, there are formed individual coils in winding-on stations on both sides of a deflecting and supporting roll. Each winding-on station may comprise two swivel arms which, independently of the swivel arms of the other winding-on stations, are adapted to be swivelled back into a depositing position. The drive of the swivel arms is provided by means of a power-medium operated tooth rack via a toothed wheel so that by a single drive means there is provided not only contact pressure for the winding-on operation but a large swivelling range of the arms. The brackets of the winding-on stations are individually movable in the cross direction, i.e., transversely, of the working range of the machine. There are arranged, in the unwinding station, particular guide rails for the tubes of the coils so that the changing of a coil may be carried out more quickly.

In detail the object of the invention comprises a roller cutting and winding machine, comprising an unwinding device having two swivel arms arranged in parallel to one another for the reception of a tube with a coil, with deflecting rolls, with broad-drawing roll, with a cutting device, and a counter cutting roll, in addition, with a deflecting and supporting roll as well as with a plurality of winding-on stations for the formation of individual coils on both sides of the supporting roll, each winding-on station comprising two brackets, movable on a traverse in the cross direction of the machine, which brackets each carry a swivel arm having a toothed wheel, being concentrically arranged in regard to the swivelling axis, engaged by a power-medium operated tooth rack, the swivel arms of each winding-on station, independent of the other winding-on stations, being adapted to be swivelled to a swivelled back depositing position.

Due to the fact that for each individual winding-on station there is provided a swivel drive having a power-medium operated tooth rack and a toothed wheel, a very large swivelling range for the swivel arms of each winding-on station is achieved so that, on the one hand, the swivel arms are adapted to be applied, within the complete coil range, by the required contact pressure and/or relieving pressure and, on the other hand, may be swivelled back from the winding position into the depositing position. In the depositing position the individual coils may be taken by a carriage.

BRIEF DESCRIPTION OF THE DRAWINGS

One embodiment of the invention will be described in the following with reference to the attached drawings, wherein.

DESCRIPTION OF THE PREFERRED EMBODIMENT

Figure 1:
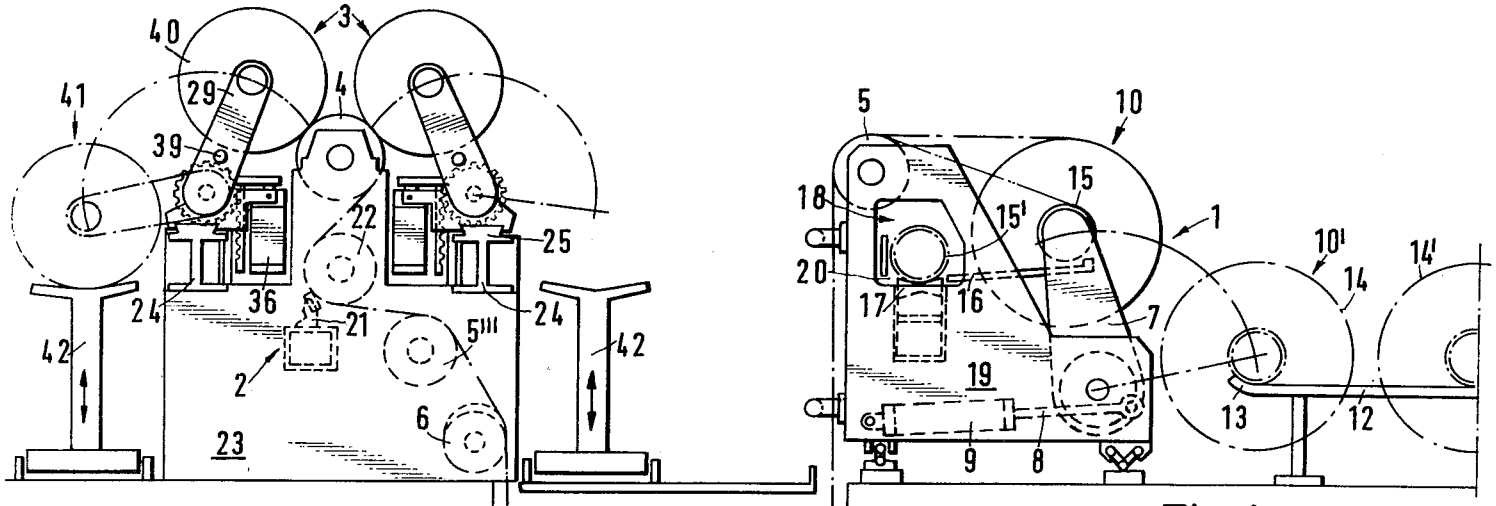
FIG. 1 is an overall view in side elevation of one embodiment of a machine according to the invention.
Figure 2:
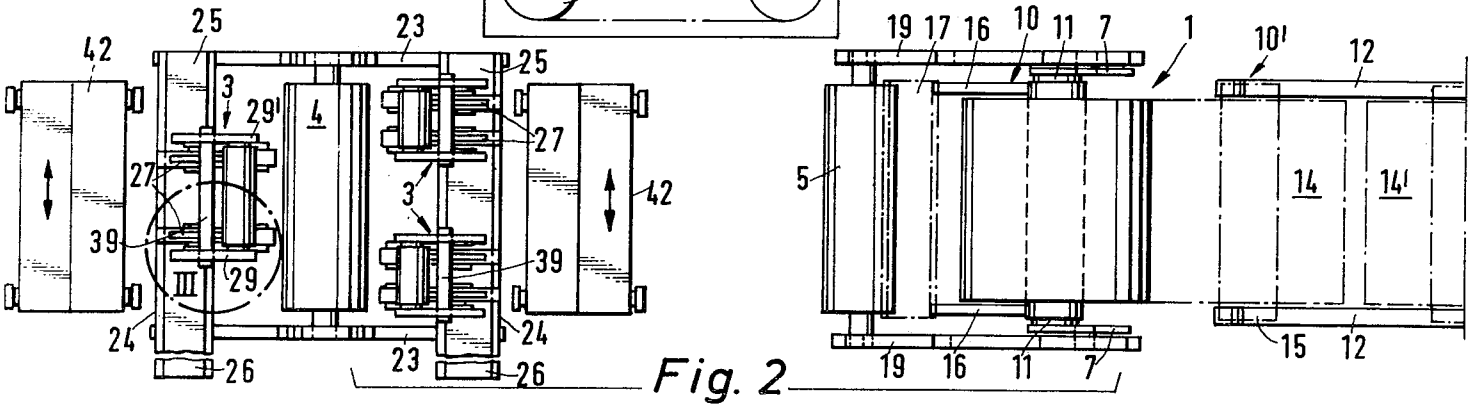
FIG. 2 is a plan view (top view) of FIG. 1.

Referring to FIGS. 1 and 2, the machine according to the invention comprises an unwinding device 1, a cutting station 2 as well as a plurality of winding-on stations 3, which are arranged alternately on both sides of a deflecting and supporting roll 4. Within the machine, in addition, a plurality of deflecting rolls 5, 5', 5'', 5''' are provided which partly are driven and partly run as dragged rolls. A broad-drawing roll 6 may also be provided.

The unwinding device 1 comprises two coil support arms 7, each pivoted to a piston rod 8 of a pressure medium unit 9 and, thus, being adapted to be swivelled between a winding-on position 10 and a receiving position 10'. Each coil support arm 7 at its free end carries a support head 11, adjustable in the axial direction.

There are provided in the receiving position 10' inlet guide rails 12 arranged in parallel to one another, each having one incline section 13. Upon these inlet guide rails 12 full coils 14, 14' may be put in readiness and may be advanced. These coils 14 or 14' are wound on coil tubes 15, the axial length of which is larger than the width of a coil so that on each front side of the coil an end portion of the coil tube 15 projects. Consequently, such end portions are supported on the guide rails 12. In the receiving position 10' a coil tube 15 with a complete coil 14 is adapted to be taken from the coil support arms 7, in that the support heads 11 engage the end portions of the specific coil tube 15. Upon that the coil support arms 7 are swivelled into the unwinding position 10. Prior to, during, or after this swivelling the leading portion of the band of the following coil is connected with the rear end of the run off coil. In the unwinding position 10 now the filled coil may be processed.

Beneath the end portions of a coil tube 15 in the unwinding position 10 there are arranged lateral guide rails 16 in parallel with one another, which lead out from the unwinding station 10 and extend to receptions 17. These receptions 17 belong to a removal station 18 comprising windows 20 in the shield plates 19 of the unwinding device 1.

If a coil in the unwinding position 10 is run off and the particular coil tube 15 is empty, the support heads 11 in the unwinding position 10 are lifted so that the coil tube 15 may fall down upon the lateral guide rail 16. The lateral guide rails 16 are inclined relative to the removal station 18 so that the coil tube 15 rolls upon the receptions 17 of the removal station 18. Subsequently, the coil support arms 7 can be swivelled into the receiving position 10' and can receive there a full coil, as already described above. The empty coil tube 15' may be removed from the removal station 18 at a later moment. Removal is easily possible through the windows 20.

The cutting station comprises in the usual manner a cutting device 21 having longitudinal cutting blades as well as a counter cutting roll 22. The longitudinally cut band strips are passed via the deflecting and supporting roll 4 alternately to the winding-on stations 3 on both sides of the deflecting and supporting roll 4.

Figure 3:
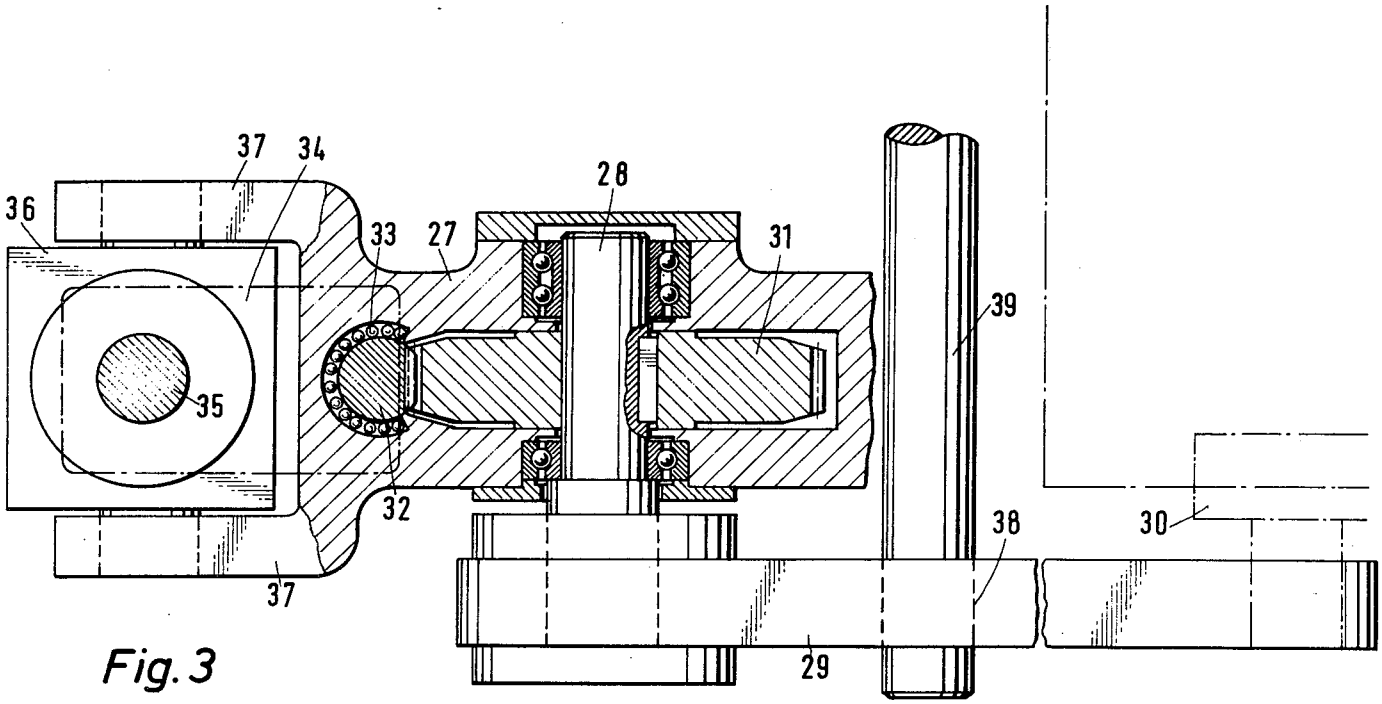
FIG. 3 is a detail view of the arrangement of a swivel arm of a winding-on station according to cutout III in FIG. 2.

Shield plates 23 carry, on both sides of the deflecting and supporting roll 4, one traverse member 24 each, having a profile rail 25. Each traverse 24 is elongated by a section 26 beyond, at least, one shield plate 23. Each winding-on station 3 comprises two brackets 27 which are guided in the profile rail 25 and are adapted to be clamped tightly there by means, not shown, so that they cannot move in the longitudinal direction of the profile rail 25. Reference is made to the detail view of FIG. 3 which shows the bracket 27 on a larger scale. In bearings of the bracket 27 there is supported a shaft 28, a swivel arm 29 being connected therewith in torsion-fixed manner. At the free end of this swivel arm 29, shown in FIG. 3 in a broken manner, there is a clamping head 30 which makes possible, together with the clamping head of the opposite swivel arm 29', the reception of a coil tube. Each clamping head 30 is clampable in a corresponding mannner within the coil tube. A toothed wheel 31 is keyed upon the shaft 28. This toothed wheel is in engagement with a tooth rack 32 which is guided within an open ball-bearing 33. The tooth rack 32 is connected by a plate 34 with the piston rod 35 of a pressure-medium unit 36 which is suspended from fork arms 37 of the bracket 27. Thereby the tooth rack 32 is also secured against torsions within the ball-bearing 33. By means of the pressure medium unit 36 the tooth rack 32 can be lifted and lowered. This linear movement of the tooth rack 32 is converted by the toothed wheel 31 into a swinging movement of the swivel arms 29.

The two swivel arms 29 and 29', belonging to one another, of a winding-on station possess, eccentrically to the axis of the shaft 28, passages 38 for an exchangeable connecting rod 39 which connect the swivel arms 29 and 29', belonging to one another, to a rigid unit and thereby exclude mutual torsions of the swivel arms 29 and 29'. By means of this connecting rod 39 it is guaranteed that the clamping heads 33 of the two swivel arms 29 and 29' are always aligned to one another in the axial direction. The connecting rod 39 is exchangeable and, thus, may be adapted to the specific coil width required.

The pressure-medium unit 36 is effective in the winding-on position and provides the specific contact pressure and/or relieving pressure for the coil 40. When the coil 40 has taken the desired material length, the material band is cross-cut by a device, not shown. Thereupon, the swivel arms 29 can be swivelled into the depositing position 41. In the depositing position 41, a carriage 42 is ready which is movable in the direction of the double-arrow in FIG. 2. In addition, the depositing table of the carriage 42 is adjustable in the direction of the double-arrow of FIG. 1. After release of the clamping heads 30, coil 40 in the depositing position 41 may be deposited upon the carriage 42. The carriage 42 then may be moved for a further handling of the coil.

As shown, the swivelling angle defined by swivel arms 29 substantially exceeds a right angle and in fact almost subtends a straight angle, i.e., 180° of rotation.

In operation of the machine according to the invention coils having different diameter and, thus, of different band length can be produced. It is possible to place these coils in the depositing position upon a carriage 42 in each case individually by means of the swivelling device as described. The pressure-medium units 36 for the two swivel arms 29 and 29' of a winding-on station allow a separate swivelling of the swivel arms of each winding-on station so that it is possible to provide the required winding pressure during the winding as well as to enable a swivelling into the depositing position. The brackets 27 of each winding station may be adjusted on the profile rail 25 in the transverse direction of the machine. If a winding station is not required, same may be placed on a section 26 of a traverse member 24 outside of the working range of the machine. The connecting rods 39 may be exchanged individually, without thereby disturbing the winding operation in the other winding-on stations. The connecting rods 39 make possible an adaptation of each winding station to the specific coil width.

I claim:

1. In a roller cutting and winding machine to cut a broad material band into a plurality of longitudinal strips and form the strips into individual coils, the combination therewith comprising:

(a) a pair of spaced apart shield plates;

(b) a deflecting and supporting roll mounted at its opposite ends between said shield plates;

(c) a pair of traverse members each having a profile rail thereon and being supported on said shield plates on opposite sides of said deflecting and supporting roll;

(d) a cutting device operatively associated with a counter cutting roll and supported between said shield plates to cut a broad material band into longitudinal strips;

(e) a plurality of winding-on stations mounted on said traverse members and operatively associated with said deflecting and supporting roll to form individual coils of the longitudinal strips upon said winding-on stations, said winding-on stations each comprising bracket means and a pair of swivel arms mounted adjacent one end thereof on shaft means journaled in said bracket means for swivelling movement of said swivel arms about a swivel axis defined by the longitudinal axis of said shaft means, clamping heads carried on said swivel arms adjacent the free ends thereof and adapted to carry a coil tube thereon, and a toothed wheel concentrically keyed to said shaft means said bracket means being supported on said traverse members and being longitudinally movable thereon to, and clampable in, a selected position thereon; and (f) a powered tooth rack engaged with said toothed wheel whereby movement of said tooth rack swivels said swivel arms about their swivel axis between a coil winding-on position and a coil depositing position.

2. The combination of claim 1 wherein said pair of swivel arms subtend a swivel angle about their swivel axis of greater than a right angle.

3. The combination of claim 2 wherein said swivel angle is less than a straight angle of 180°.

4. The combination of claim 1 wherein said clamping heads of a pair of swivel arms are axially retractable with respect to each other.

5. The combination of claim 1 wherein said bracket means comprises a pair of brackets, said shaft means comprises two shafts, one journaled in each of said brackets, and said brackets are individually movable along their associated traverse member.

6. The combination of claim 4 further including connecting rods one of which connects each said pair of swivel arms to each other eccentrically with respect to their swivel axis.

7. The combination of claim 1 wherein said traverse members extend exteriorly beyond at least one of said shield plates so that said brackets and swivel arms can be moved out of the range of the machine.

8. The combination of claim 1 further including an unwinding device having a pair of coil support arms swivelable between an unwinding position and a receiving position and having respective free ends at which support heads are respectively mounted, said support heads being adapted to support a tube from which a coil of said broad material band is unwound when said unwinding device is in said unwinding position and further including lateral guide rails positioned transversely of the coil axis defined between said support heads.

9. The combination of claim 8 further including a removal station disposed adjacent one end of said lateral guide rails.

10. The combination of claim 9 wherein said lateral guide rails are inclined downwardly from the horizontal towards said removal station.

11. The combination of claim 9 further including inlet guide rails which extend into the receiving portion of said unwinding device.

12. A roller cutting and winding machine comprising:

(a) an unwinding device having a pair of coil support arms swivelable between an unwinding position and a receiving position and having respective free ends at which support heads are respectively mounted, said support heads being adapted to support a tube from which a coil of a broad material band is unwound when said unwinding device is in its unwinding position;

(b) a pair of spaced-apart shield plates;

(c) a deflecting and supporting roll mounted at its opposite ends between said shield plates;

(d) a pair of traverse members each having a profile rail thereon and supported on said shield plates on opposite sides of the longitudinal axis said deflecting and supporting roll;

(e) a cutting device operatively associated with a counter cutting roll and supported between said shield plates to cut the broad material band into longitudinal strips:

(f) a plurality of winding-on stations mounted on said traverse members and operatively associated with said deflecting and supporting roll to form individual coils of the longitudinal strips upon said winding-on stations, said winding-on stations each comprising a pair of brackets and a pair of swivel arms mounted adjacent one end thereon on respective shafts journaled, one each in said brackets coaxially for swivelling movement of said swivel arms about a common swivel axis defined by the longitudinal axis of said shafts, clamping heads carried on said swivel arms adjacent the free ends thereof and adapted to carry a coil tube thereon and a pair of toothed wheels each concentrically keyed to a respective associated one of said shafts, being supported on said traverse members and being longitudinally movable on said traverse members to, and clampable in, a selected position thereon, said winding-on stations further including a connecting rod connecting said pair of swivel arms of a winding-on station to each other eccentrically with respect to the swivel axis;

(g) a powered tooth rack engaged with said toothed wheel whereby movement of said tooth rack swivels said swivel arms about their swivel axis between a coil winding-on position and a coil depositing position; and (h) roll means positioned intermediate said unwinding device and said deflecting and supporting roll for transporting said material band therebetween.

* * * * *